US007245866B2

(12) United States Patent
Fröhlich

(10) Patent No.: US 7,245,866 B2
(45) Date of Patent: Jul. 17, 2007

(54) DEVICE AND METHOD FOR A PRINTING AND/OR COPYING DEVICE WITH REDUCED THERMAL STRESS ON THE SUPPORT MATERIAL

(75) Inventor: Georg Fröhlich, Ottobrunn (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 10/312,237

(22) PCT Filed: Jun. 22, 2001

(86) PCT No.: PCT/EP01/07106

§ 371 (c)(1),
(2), (4) Date: Jul. 10, 2003

(87) PCT Pub. No.: WO01/98840

PCT Pub. Date: Dec. 27, 2001

(65) Prior Publication Data

US 2004/0005178 A1 Jan. 8, 2004

(30) Foreign Application Priority Data

Jun. 23, 2000 (DE) ..... 100 30 739

(51) Int. Cl.
*G03G 15/20* (2006.01)

(52) U.S. Cl. ..... 399/341; 399/336

(58) Field of Classification Search ..... 399/320, 399/335, 336, 337, 341
See application file for complete search history.

(56) References Cited

U.S. PATENT DOCUMENTS 4,467,335 A 8/1984 Schmidt et al.

(Continued)

FOREIGN PATENT DOCUMENTS

DE 2 130891 12/1971

(Continued)

OTHER PUBLICATIONS

Japanese Abstract, Publication No. 11024466, Jan. 29, 1999.

(Continued)

*Primary Examiner*—David M. Gray
*Assistant Examiner*—Ryan Gleitz
(74) *Attorney, Agent, or Firm*—Schiff Hardin LLP

(57) ABSTRACT

An apparatus and method for performing a second toner image fixing on a toner image on a carrier material includes a second fixing unit in the carrier material transport path. The second fixing unit is in a burn-in unit that is spaced by a cooling distance from the printer or copier and its toner fixing unit. The first fixing unit of the printer or copier fixes the toner image in a first fixing condition and the second fixing unit fixes the toner image in a second fixing condition. For printers or copiers that perform two sided printing and have front and back side fixing units, the burn-in unit also has front and back side fixing units for fixing the toner image in the second fixing condition. A controller may be provided to reduce the heat energy applied to the first fixing unit in the printer or copier to partially fix the toner image so that the second fixing unit further fixes the toner image.

50 Claims, 8 Drawing Sheets

U.S. PATENT DOCUMENTS

| | | | | |
|---|---|---|---|---|
| 4,634,257 | A | | 1/1987 | Yoshino et al. |
| 5,392,096 | A | | 2/1995 | Deets, II |
| 5,713,071 | A | | 1/1998 | Hausmann |
| 5,835,836 | A | * | 11/1998 | Hirao ..... 399/336 |
| 5,983,064 | A | | 11/1999 | Green et al. |
| 6,147,662 | A | * | 11/2000 | Grabau et al. |

FOREIGN PATENT DOCUMENTS

| | | | |
|---|---|---|---|
| DE | 32 21 059 | | 12/1983 |
| DE | 35 01 303 | | 7/1985 |
| DE | 40 36 975 | A1 | 5/1991 |
| DE | 197 09 504 | A1 | 11/1997 |
| EP | 0 034 817 | | 9/1981 |
| EP | 0 107 722 | | 5/1984 |
| EP | 0 789 860 | | 8/1997 |
| GB | 2 110 597 | A | 6/1983 |
| JP | 10274903 | A * | 10/1998 |
| JP | 2000075710 | A * | 3/2000 |
| WO | WO 98/27466 | | 6/1998 |
| WO | WO 98/39691 | | 9/1998 |

OTHER PUBLICATIONS

Japanese Abstract, Publication No. 57201273, Dec. 9, 1982.
Japanese Abstract, Publication No. 60252380, Dec. 13, 1985.
R. Moser, "Extended Dwell Paper Decurler", Xerox Disclosure Journal, vol. 17, No. 4, Jul./Aug. 1992, pp. 223-224.
IBM Technical Disclosure Bulletin, "Two-Step Fusing Process and Accessory for Laser Printers", vol. 40, No. 08, Aug. 1997, pp. 23-25.

* cited by examiner

Testprotokoll: Security Printing
Prüfanstalt: PIRA
Qualitätskriterien: gemäß APACS-Klassifizierung

| Test | Normalfixierung | umhüllt mit Sicherheitsfolie | Stufenfixierung |
|---|---|---|---|
| Blu-Tack | 1 | 1 | 1 |
| Radierer | 3 | 2 | 1 |
| Skalpell | 4 | 1 | 1 |
| Skalpell (gealterte Probe) | 1 | 1 | 1 |

Fig. 7

DEVICE AND METHOD FOR A PRINTING AND/OR COPYING DEVICE WITH REDUCED THERMAL STRESS ON THE SUPPORT MATERIAL

BACKGROUND OF THE INVENTION

1. Field of the Invention

The present invention relates generally to an apparatus for a printer and/or copier device and, in particular, to a burn-in station apparatus that can be coupled to the printer and/or copier device. The invention is also directed to a printer and/or copier device having a printing unit that generates a latent image, develops it with toner and transfer-prints the developed toner image onto a carrier material. A fixing unit that fixes the transfer-printed toner image on the carrier material is arranged in the printer and/or copier device. The invention is also directed to a method for printing a carrier material.

2. Description of the Related Art

Many printers and copiers use toner to generate an image on a carrier material, such as paper. The toner must be fixed on the carrier to ensure that it does not rub off. A high quality and durable fixing of the toner image on the carrier is increasingly expected from modern electrographic printer and/or copier systems. Specifically, the dry toners employed in electrophotography contain mainly meltable synthetic resins that melt when heat is applied. Depending on the fixing method, the thermal energy is transmitted onto the toner and onto the paper either by radiation, for example using a photoflash or infrared radiation fixing, or by thermal contact, for example using hot rolling or trans-fixing (intermediate image transfer and fixing).

European patent application EP 0 789 860 B1 has disclosed a multi-functional electrographic printer device for single-sided or both-sided printing of recording media in a start-stop mode. This patent application as well as the corresponding U.S. Pat. No. 5,713,071 are hereby incorporated by reference into the present specification.

The electrographic printer devices disclosed in these patent applications have two fixing stations. The first fixing station fixes the toner image which has been transfer-printed onto the front side of the carrier material, and the second fixing station fixes the toner image which has been transfer-printed onto the back side of the carrier material. The fixing thereby ensues with a thermal printing fixing station having a heated fixing drum and an appertaining pressure drum. The possibility of fashioning the thermal printing fixing station with a heated or unheated admission saddle is also disclosed. The possibility of fixing the image with the assistance of a photoflash fixing device as well as with the assistance of a cold fixing device is also disclosed in these patent applications.

In order to achieve a high coincidence of the position of the print images on the front side and back side in duplex printing, it must be assured that there is only a slight change in size of the carrier material, for example of the paper, when fixing the image on the first transfer-printed side, for example the front side, of the carrier material. Fixing of the toner image onto the paper results in moisture being removed from the paper due to the thermal influence of the fixing operation, so that the paper shrinks. When the second toner image is subsequently transferred onto the other side of the paper, for example onto the back side, there occurs a size difference of the print images due to the shrinkage which is temperature dependent. The paper is stressed due to the thermal influence during fixing. The heat application must be reduced in order to keep the stress on the paper low, i.e. in order to reduce the shrinkage of the paper. However, enough heat must be supplied so that the toner of the transfer-printed toner image melts and is thus fixed.

Low melting temperatures are an aim in recent developments of toners in order to be able to reduce the heat application when fixing the toner on the carrier material.

It is necessary to limit the temperature influence on the carrier material and to achieve a qualitatively high-grade fixing at the same time, particularly when generating printed products having enhanced demands such as are required to protect against counterfeiting, in what is referred to as security printing. In order to assure a durable adhesion of the fixed toner on the carrier material, it is necessary that so much energy be supplied to the toner that it becomes fluid in order to penetrate into the carrier material.

When printing self-adhesive labels and carrier material that contains integrated circuits, it is also necessary to keep the amount of heat transferred onto the carrier material low.

The following documents are referenced as further Prior Art: U.S. Pat. No. 5,983,064; U.S. Pat. No. 5,392,096; German Patent document DE 35 01 303 A1; German Patent document DE 32 21 059 A1; U.S. Pat. No. 4,634,257; Xerox Disclosure Journal, 17, No. 4, pp. 223-224; Published PCT International Application WO 98/27466; German Patent document DE 40 36 975 A1; European Patent document EP 0 107 722 B1; British Patent document GB 2 110 597 A; European Patent document EP 0 034 817 A2; German Patent document DE 21 30 891 A1; Published PCT International Application WO 98/39691; and German Patent document DE 197 09 504 A1.

Published PCT International Application WO98/39691 discloses a printer or copier device for performance-adapted printing of a recording medium. The printer or copier device contains a modularly arranged fixing unit. Japanese Letters Patent JP 57201273 discloses an arrangement for fixing toner images on a carrier material. A photoflash fixing unit that is controlled dependent on the properties of the carrier material is utilized for fixing. The document "TWO STEP FUSING PROCESS AND ACCESSORY FOR LASER PRINTERS" IBM TECHNICAL DISCLOSURE BULLETIN, IBM CORP. NEW YORK, US, Vol. 40, No. 8, 1 Aug. 1997 (1997-08-01), pages 23-25, XP000735565 ISSN: 0018-8689 discloses that a drum fixing and a radiant fixing be successively implemented in order to fix a toner image on a carrier material in a laser printer. Japanese Letters Patent JP 60252380 A discloses a pressing and hot-fixing unit for fixing toner images on a carrier material. The control of the pressing and hot-fixing unit ensues dependent on properties of the carrier material.

SUMMARY OF THE INVENTION

The present invention provides an apparatus and a method with which it is possible to durably fix a toner image applied onto a carrier material, so that the fixed toner image is dependably and durably connected to the carrier material even given mechanical stressing.

This is achieved for a first embodiment by an apparatus for a printer and/or copier device to which a carrier material with a toner image transfer-printed onto the carrier material and already fixed on the carrier material with a first fixing unit can be supplied, whereby the apparatus is fashioned as a burn-in station that can be electrically and/or mechanically coupled to the printer and/or copier device, the burn-in station comprising a second fixing unit that fixes the image which has been fixed in a first fixing condition on the carrier material by the first fixing unit into a second fixing condition, the second fixing unit is designed to be controllable with respect to its fixing properties, and a cooling distance is arranged preceding the second fixing unit.

In a second embodiment, a printer and/or copier device comprises a printing unit that generates a latent image, develops it with toner and transfer-prints the developed toner image onto a carrier material, the printing unit having a first fixing unit that fixes the transfer-printed toner image in a first fixing condition on the carrier material, a second fixing unit that fixes the image fixed by the first fixing unit in a second fixing condition, at least one of the fixing units being designed to be controllable with respect to its fixing properties, and a cooling distance that is arranged preceding the second fixing unit.

According to a further embodiment, a method for printing a carrier material is provided, whereby a toner image is transfer-printed onto a carrier material, the transfer-printed toner image is fixed in a first fixing condition on the carrier material in a first fixing stage, the image fixed in the first fixing stage is fixed in a second fixing condition in a second fixing stage, the fixing in at least one of the fixing stages is designed to be controllable with respect to its fixing properties, and a cooling distance is provided preceding the second fixing stage.

BRIEF DESCRIPTION OF THE DRAWINGS

Further features and advantages of the invention derive from the following description that explains the invention on the basis of an exemplary embodiment in combination with the attached drawings.

FIG. 7 is a table with the results of a test protocol of the PIRA Testing Institute (Printing Industries Research Association) of toner images fixed on paper according to APACS testing guidelines (class 1-2) for printed products with stricter demands made of the security against counterfeiting and of the durability that have been fixed with the second fixing unit of an electrographic printer device.

DETAILED DESCRIPTION OF THE PREFERRED EMBODIMENTS

Figure 1:
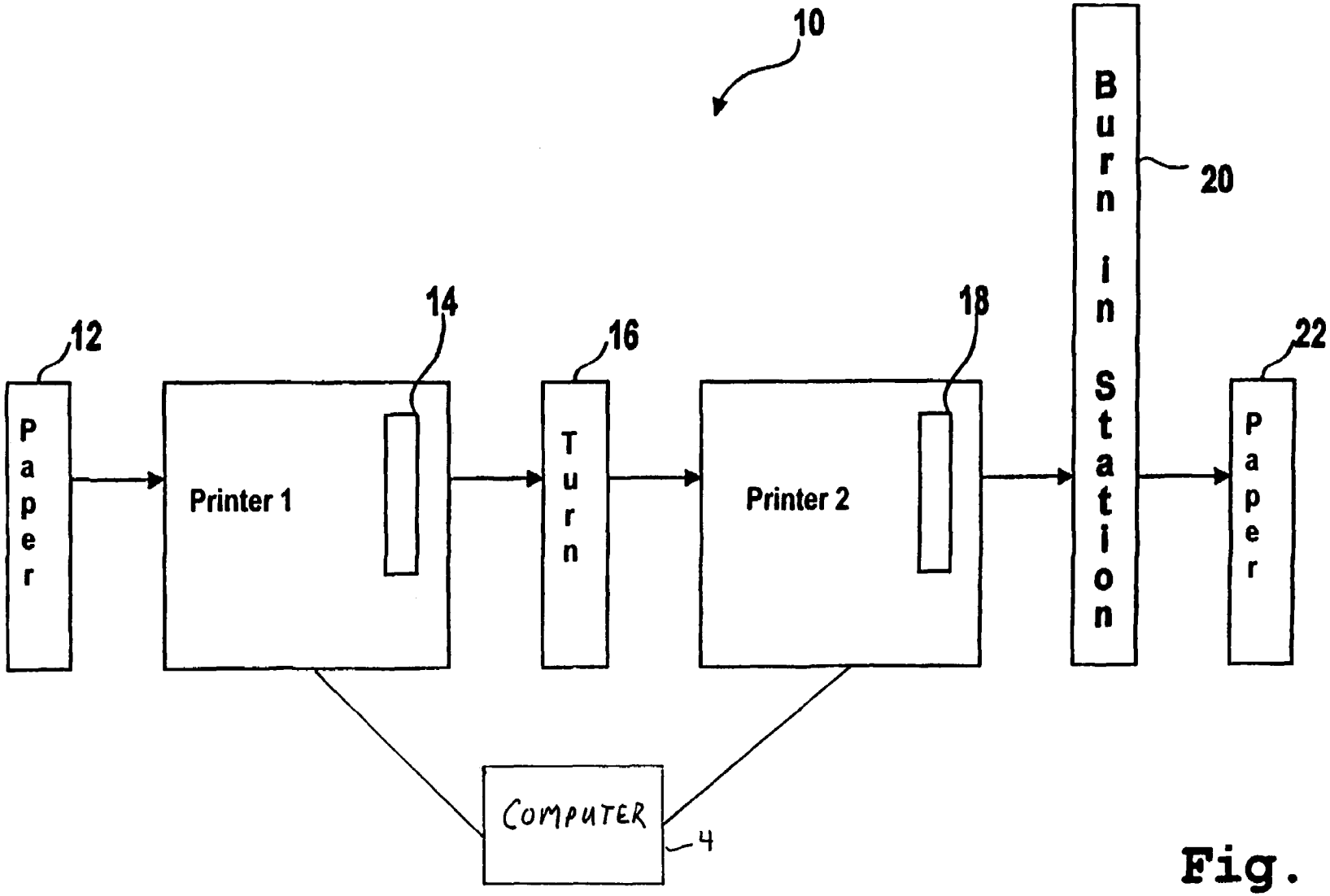
FIG. 1 is a functional block diagram that shows a printer and/or copier device that contains two printers as well as a separate burn-in station according to the principles of the invention.

According to the present apparatus, a burn-in station containing a second fixing unit can be coupled to the printer and/or copier device having a first fixing station. For example, the second fixing unit can be docked to the printer and/or copier device. Alternatively, the burn-in station can be integrated in the printer and/or copier device and can preferably be replaceable and detachable in the printer and/or copier device.

The first and/or second fixing units are designed so that their fixing properties are controllable or can be regulated. In the case of radiant heat fixing, further, the passage distance or, respectively, the passage time of the carrier material can be set or, on the other hand, the intensity of the photoflash can be set for photoflash fixing. It is also possible to roll the fixed toner image in order to thus produce a gloss finish. Also important in multi-stage fixing is the matching of the fixing stages to one another in order to thus achieve an excellent overall fixing result and, for example, to thus enhance the "abrasion resistance" fixing property. To this end, one of the fixing stages can also contain a moistening device. This compensates the paper stress and the paper becomes more elastic. Further, an ironing effect is thus prevented, or at least its effect is reduced.

By fixing a toner image that has been transfer-printed onto a carrier material in a first fixing condition in a first fixing stage and in a second fixing condition in a second fixing stage, the present invention achieves a lowering of the heating energy applied to the carrier material and, thus, the mechanical stressing on the carrier material is lower while still having the same fixing result as use of a single-stage fixing. The carrier material is not stressed as much as in a single-stage fixing, which is especially advantageous for duplex printing. Temperature-sensitive carrier materials such as, for example, chip cards or self-adhesive labels can be printed without damaging these sensitive carrier materials. Security elements such as impressed holograms and security films that are damaged if subjected to too great a thermal influence can also be printed with the assistance of this electro-photographic printer and/or copier device.

Given such a printer and/or copier device, toner that contains fillers with which a magneto-readable print image can be generated can also be utilized for producing the print image. Such fillers preferably contain iron or, respectively, are magnetic.

The fixing of the unfixed toner image ensues in a first stage with the assistance of the first fixing unit, whereby the transfer-printed toner image is fixed in the first fixing condition. The further fixing of the toner image that has been fixed with the assistance of the first fixing stage ensues in a second stage with the assistance of the second fixing unit, whereby the toner image is fixed in the second fixing condition. Such a two-stage fixing is also referred to below as stage fixing.

In one embodiment of the invention, the first and the second fixing units are radiant fixing units. What is achieved as a result of the use of such radiant energy fixing units is that the radiation emitted by the fixing unit is partially reflected by light-colored carrier material, for example by white paper, and is absorbed by darkly colored toner, for example by the black toner. The thermal influence on the carrier material is comparatively slight. When paper is employed as the carrier material, the paper is stressed comparatively little. The employment of what is referred to as a fusing oil as employed in a thermal press fixing step can be foregone when using radiant fixing units. Given employment of a thermal press fixing as the first fixing unit and/or of a thermal press fixing unit as the second fixing unit, the two-stage fixing also allows the fixing temperature of these fixing units to be reduced compared to a single thermal press fixing unit in a single-stage fixing. As a result thereof, it is possible to reduce the emergence of fusing oil as a consequence of an increased need for fusing oil in the thermal press fixing.

It is also advantageous to arrange the second fixing unit of the printer and/or copier device in a separate structural unit. This establishes the possibility of retrofitting existing printer and/or copier device with a second fixing unit, whereby the performance of the fixing unit present in the existing printer and/or copier device is correspondingly adapted. There is thus also the possibility of implementing the second fixing step with the assistance of this separate, second fixing unit independently of the remaining printer and/or copier device. To that end, a latent image is generated by a printing unit, it is developed with toner, and the developed toner image is transfer-printed onto a carrier material, for example, onto single sheets or onto continuous form material. The transfer-printed toner image is fixed in a first fixing condition with the assistance of the first fixing unit. The carrier material having the toner image fixed in the first fixing condition is, for example, stacked or rolled up dependent on the type of carrier material. In a second work process, the stacked or rolled-up carrier material is supplied to the separate structural unit and, thus, to the second fixing unit in an electrically or, respectively, mechanically coupled arrangement. This establishes the possibility of implementing the fixing with the assistance of the second fixing unit in a separate process independently of starts and stops of the remaining printer device. Since, particularly given radiant fixing devices, the fixing quality is dependent on a continuous transport of the carrier material and since the carrier material can be damaged due to too great a thermal influence as a consequence of a standstill of the carrier material, buffer distances, for example loop-forming devices, are preferably provided in the coupled on-line linking between the printer device with the first fixing unit and the second fixing unit.

In another advantageous embodiment of the invention, the electrographic printer and/or copier device also has a moistening device, a cooling device and/or a discharge device that preferably follows the second fixing unit. What is thereby achieved is that the carrier material is placed into a condition that is suitable for the further-processing of the printed carrier material.

It is also advantageous to utilize paper and/or plastic as carrier material. The carrier material can also contain self-adhesive labels or be composed of self-adhesive labels and can also contain at least one integrated circuit. The electrographic printer and/or copier device also makes it possible to print carrier materials that would be damaged or destroyed in known electrographic printer and/or copier devices as a consequence of high temperature influences and/or mechanical actions of the fixing unit. When the fixing temperature in known printer and/or copier devices is reduced, the fixing quality drops, so that the fixed toner image more easily separated from the carrier material given mechanical influence on the carrier material and/or on the fixed toner image compared to use of fixing without reducing the thermal influence on the carrier material. In contrast, carrier materials that contain chip cards such as, for example, address labels with integrated, contactless chip cards for tracking shipped goods and for printed products with stricter demands made of the security against counterfeiting such as, for example, flight tickets, admission tickets, checks, vouchers, motor vehicle titles and identification papers can also be produced with the inventive printer and/or copier device with high fixing quality and low thermal stressing of the carrier material. It is thereby advantageous when the second fixing unit supplies the thermal energy required for fixing to the toner without direct mechanical contact with the fixing unit. A nearly linear paper running is also advantageous.

In an advantageous development of the invention, the carrier material is printed on both sides. The toner image that has been transfer-printed onto the front side is fixed by the first fixing unit. The toner image that has been transfer-printed onto the back side of the carrier material is fixed by a third fixing unit. The toner image of the front side that was fixed by the first fixing unit is further fixed by the second fixing unit, and the toner image of the back side that was fixed by the third fixing unit is further fixed by a fourth fixing unit, whereby the second and the fourth fixing unit can simultaneously fix the front side and the back side of the carrier material in the second fixing condition. It is thus possible to also effectively utilize the invention in duplex printing, namely in vertical and horizontal arrangements.

In another advantageous embodiment of the invention, a temperature-regulated guide path or, respectively, temperature compensation path is provided preceding the second fixing unit or, respectively, preceding the second and/or fourth fixing unit. What is thereby achieved is that the carrier material is supplied to the second and/or to the fourth fixing unit with a pre-defined temperature, and a constant fixing quality is thus achieved. This guide path also prevents too great a heat quantity from being stored in the carrier material, this heat having been supplied to the carrier material by the first and/or third fixing unit and producing a temperature in the carrier material that is further increased by the heat quantity supplied to the carrier material by the second and/or fourth fixing unit so that the resulting temperature damages or destroys the carrier material.

By fixing the toner image that has been transfer-printed onto the carrier material in two stages, a high quality fixing is achieved. The vitrification (or melting) of the toner material is controlled in a defined fashion during the fixing processes in stages and is thus specifically matched to the glass transition point, which is dependent on the toner material. The toner material becomes sticky and begins to melt at the glass transition point. The heating of the carrier in the fixing event when using multi-stage fixing is lower while achieving the same fixing quality compared to fixing with the a single fixing unit. Depending on the type and temperature sensitivity of the carrier material, it is advantageous to regulate the heat quantity generated by the fixing units and/or the temperatures of the fixing units. Carrier materials that are composed of temperature-sensitive materials and/or that contain such materials such as, for example, labels or credit cards can thereby also be printed with high quality. Further, thickness differences of the labels that are glued on, and which are to be printed and have the image fixed can be compensated without a negative influence on the adhesive force of the adhesive surfaces.

FIG. 1 shows an inventive printer and/or copier device 10 that has two printers 1 and 2, in what is referred to as a twin station, and a separate structural unit 20 in which a second and fourth fixing unit are arranged. Paper is utilized as the carrier material in this exemplary embodiment. The carrier, however, can also contain or be composed of films, plastics, for example chip cards, self-adhesive labels, as well as integrated circuits. The paper is located in a paper supply 12.

In this exemplary embodiment, the paper supply 12 contains a paper stack of continuous form paper with transport holes and perforations that contains self-adhesive labels on the form paper. This continuous form paper is supplied to the printer 1. However, paper in the form of individual sheets or in roll form with or without perforations as well as with and without transport holes can also be utilized as the carrier material. The printer 1 is also connected to a calculating unit or computer 4 that communicates print data to the printer 1 for printing the front side of the paper. The printer 1 generates a latent image of the front side, develops this image by inking with toner, transfer-prints this toner image onto the paper and fixes it with the assistance of a first fixing unit 14, which here is a photoflash fixing unit, in a first fixing condition. The paper with the fixed front side image is supplied to a turning device 16 that turns the paper by 180° and supplies it to a printer 2.

The structure of the printer 2 is identical to that of the printer 1. The printer 2 is likewise connected to the calculating unit or computer 4 and receives print data from it from which it generates a latent image of the page side, inks this with toner, transfer prints this onto the back side of the paper and fixes it in a first fixing condition with a third fixing unit 18. The paper printed on both sides in this way is supplied to a separate structural unit 20, which is referred to as the burn-in station. A second fixing unit and a fourth fixing unit are arranged in the burn-in station 20, whereby the second fixing unit is provided for fixing the front side of the paper and the fourth fixing unit is provided for fixing the back side of the paper.

The second and the fourth fixing units are radiant heat fixing units that irradiate the paper, particularly the toner image on the paper, with infrared radiation and thus fix it in a second fixing condition. Further devices such as, for example, a moistening device, a cooling device and a discharge device are arranged in this burn-in station, these influencing the paper such that the paper leaves the burn-in station 20 with pre-defined parameters. These further devices are driven by a controller (not shown) that assures the pre-defined parameters of the paper with the assistance of a regulator.

Subsequently, the paper is supplied to a stacking device 22 or, respectively, to a roll-up device. The air path between printer 2 and the burn-in station 20 serves as a cooling distance for the paper, so that the paper is supplied to the second and to the fourth fixing unit in the burn-in station 20 with a temperature that is constant in a prescribed range. In other exemplary embodiments, however, it is possible that the burn-in station 20 together with the printing units and fixing stations 14 and 18 of the printers 1 and 2 form a structural unit, i.e. are arranged in one housing.

Figure 2:
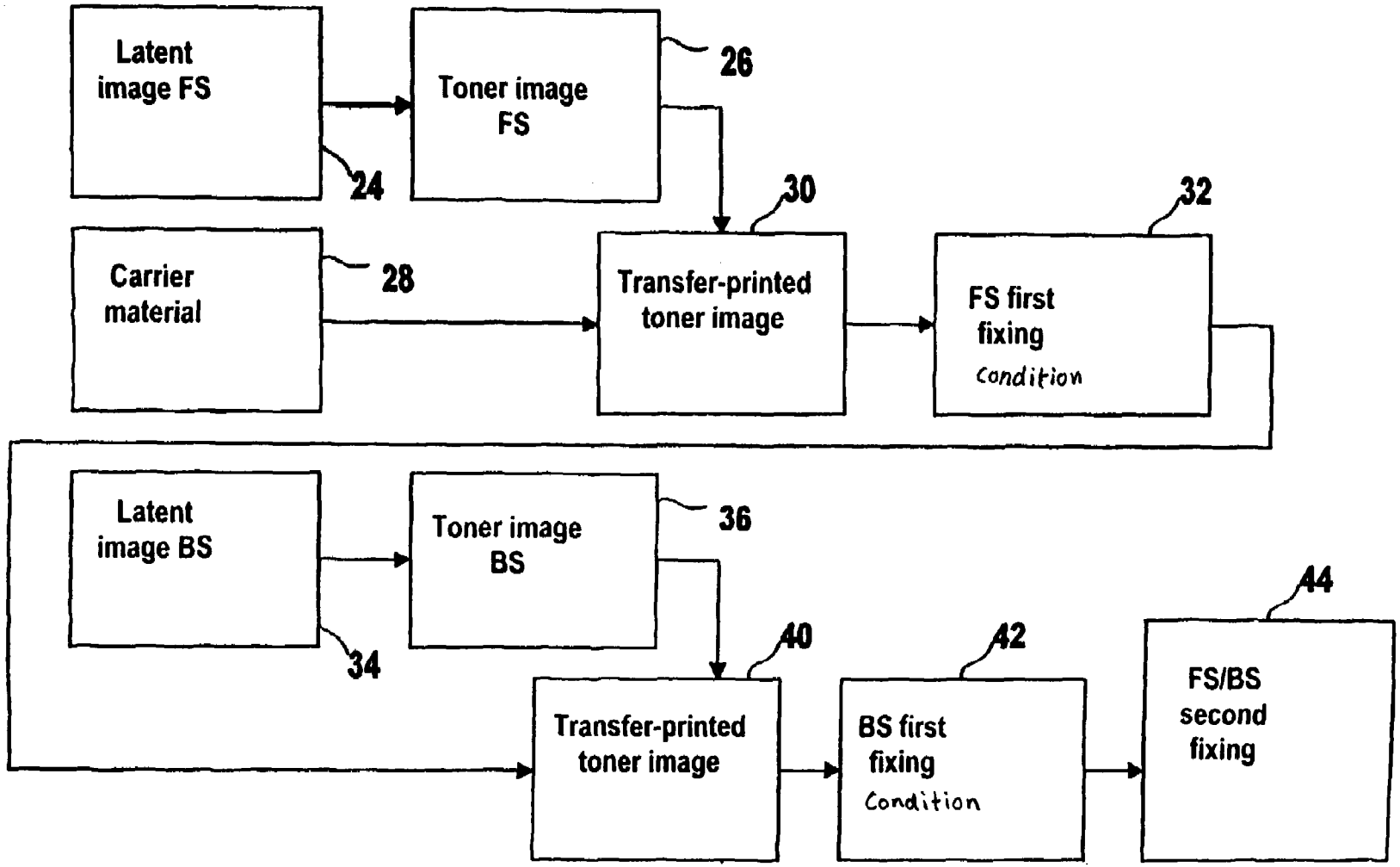
FIG. 2 is a functional block diagram that shows a schematic overview of the process steps for generated print on both sides of a carrier material with an arrangement according to FIG. 1.

FIG. 2 shows a schematic overview directed to the inventive generation of a carrier material printed on both sides. A latent image 24 for the front side (FS) is generated from print data in the printer 1 with the assistance of a known electrographic method, a toner image 26 for the front side being subsequently generated from the latent image 24 with the assistance of a known developer unit. The printer 1 is also supplied with carrier material 28, for example paper, onto which the toner image 26 for the front side is transfer-printed to form a transfer-printed toner image 30 on the front side of the paper 28. The paper 28 with the transfer-printed toner image 30 is supplied to the first fixing unit 14 of the printer 1, which fixes the transfer-printed toner image 30 on the front side in a first fixing condition 32. The quantity of heat output by the first fixing unit 14 and, thus, the temperature of the carrier material 28 is regulated dependent on the preset type and temperature sensitivity of the carrier material.

A latent image 34 for the back side (BS) is generated from print data in the printer 2 with the assistance of a known electrographic method, is inked with toner by a known developer unit to form a toner image 36 for the back side, and is transfer-printed with the assistance of a known transfer-printing device onto the back side of the paper 28 which has already been printed by the printer 1 to form a transfer-printed toner image 40 on the backside. The transfer-printed toner image 40 on the back side is fixed in a first fixing condition 42 in the third fixing unit 18 of the printer 2. The quantity of heat output by the third fixing unit 18 and, thus, the temperature of the carrier material is regulated dependent on the preset type and temperature sensitivity of the carrier material. The paper 28 which has been printed on both sides is supplied to the burn-in station 20.

In the burn-in station 20, the toner image 32 on the front side which has been fixed in the first fixing condition and the toner image 42 on the back side which has been fixed in the first fixing condition are fixed in a second fixing condition 44 with the assistance of a second and a fourth fixing unit.

Figure 3:
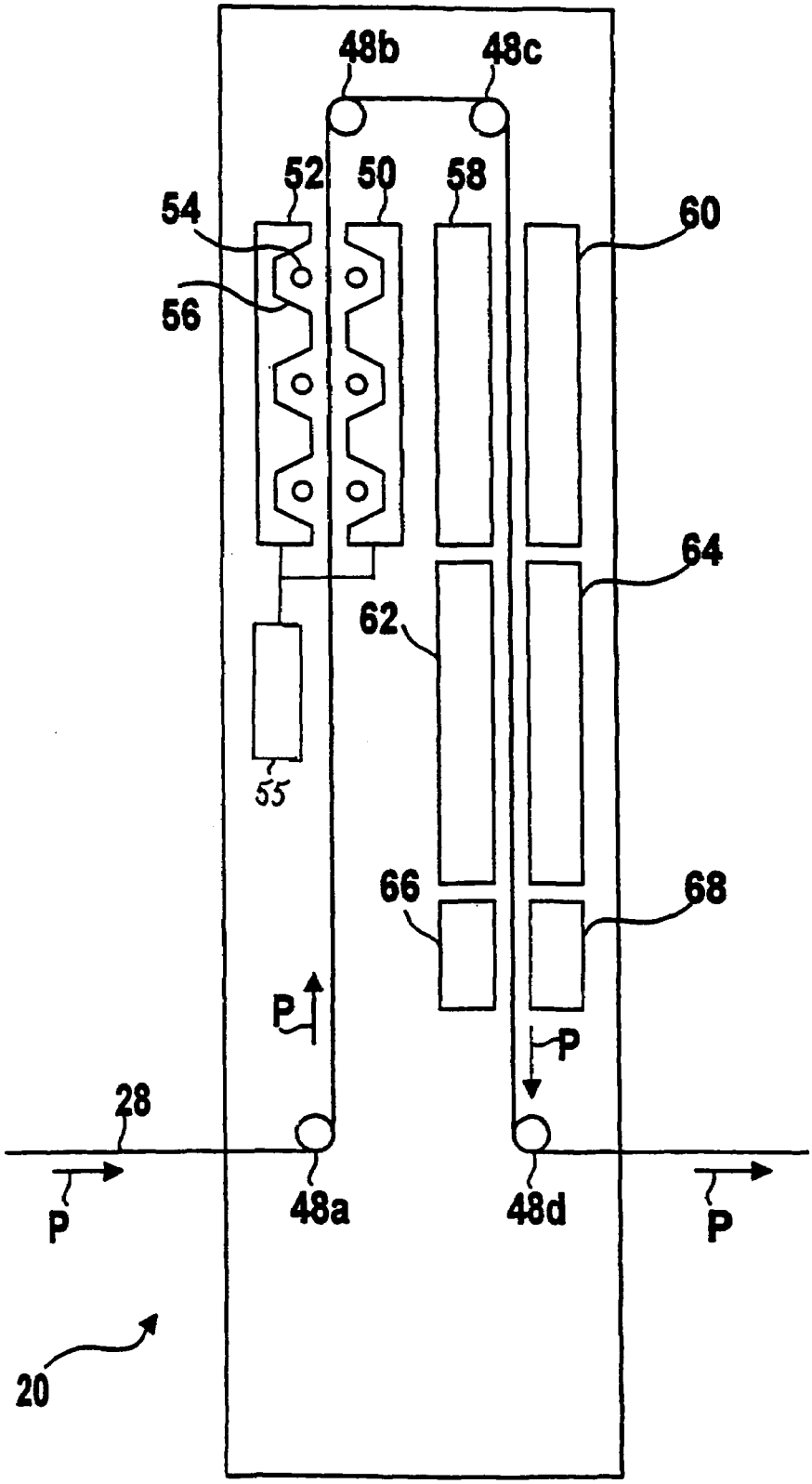
FIG. 3 is a schematic side view that shows the structure of the burn-in station from FIG. 1.

FIG. 3 shows the schematic structure of the burn-in station 20 for both-sided, simultaneous fixing of the front side and back side of the paper 28. With the assistance of guide and drive rollers 48*a*, 48*b*, 48*c* and 48*d*, the paper 28 is supplied in the direction of the arrow P in conformity with the printing speeds of the printers 1 and 2. A second fixing unit 50 fixes the front side toner image 32 located on the paper into the second fixing condition 44, the toner image 32 having been fixed into the first fixing condition by the first fixing unit 14. A fourth fixing unit 52 fixes the toner image 42 on the back side into the second fixing condition 44, the toner image 42 having been fixed in the first fixing condition 42 with the third fixing unit 18 (FIG. 1).

The fixing devices 50 and 52 are radiant heat fixing devices and contain six quartz heating rods 54, three of which are disposed at each side of the paper. The heating rods 54 are interchangeably designed and individually drivable in groups. The quartz heating rods 54 are connected to a voltage supply unit (not shown). Corresponding to a signal of a controller 55, the calorific output of the quartz heating rods 54 is regulated on the basis of the transport velocity of the paper 28 and on the preset type and temperature sensitivity of the paper 28. The radiant heat output by the quartz heating rods 54 is partially reflected by reflectors (one of the reflectors being referenced 56) such that the radiant heat is supplied to the paper 28. The radiant heat is absorbed by the toner, particularly if dark toner has been used.

The white surfaces of the paper 28 partially reflect the incident radiant heat of the quartz heating rods 54. The fixing energy is thus mainly supplied to the toner of the front side and back side toner images 32 and 42. The toner is heated such that it becomes liquid and penetrates into the paper fibers of the paper 28. The penetration is promoted by the capillary action of the paper 28. Given toners that contain particles that do not melt during fixing, for example given MICRA toners, a part of the toner penetrates into the paper 28. The non-melting particles are embedded in the molten part of the toner on the paper surface which bonds them to the paper surface. Even when subjected to a great deal of mechanical stress, the toner is thus firmly joined to the paper 28. Instead of the radiant fixing units 50 and 52, correspondingly adapted thermal press fixing units with or without a pre-heating saddle, photoflash fixing units or trans-fix fixing units can also be utilized.

The use of a cold fixing device is technically conceivable; however, a cold fixing device should not be utilized for environmental reasons. Particularly given dark toners, however, it is meaningful to utilize radiant fixing units such as radiant heat fixing units and photoflash fixing units in order to keep the heating of the paper 28 low.

After the fixing of the paper 28 by the fixing units 50 and 52, the paper 28 is conducted past moistening devices 58 and 60, past cooling devices 62 and 64 and past discharge devices 66 and 68. The moistening devices 58 and 60, the cooling devices 62 and 64 and the discharge devices 66 and 68 serve the purpose of assuring that the printed paper 28 has pre-defined parameters after leaving the burn-in station 20 that facilitate or, respectively, do not impede the further-processing of the printed paper 28, for example the stacking or, respectively, roll-up of the paper 28 with the assistance of the paper stacker or, respectively, roll-up device 22 or the separation with a cutter.

The second and fourth fixing units 50 and 52, the moistening devices 58 and 60, the cooling devices 62 and 64 and the discharge devices 66 and 68 are vertically arranged in the burn-in station. As a result thereof, the heat of the second and fourth fixing units 50 and 52 can escape by natural convection, for example given a standstill of the carrier material 28. The linear vertical paper guidance in the burn-in station 20 with the following cooling distance that contains the moistening devices 58 and 60, the cooling device 62 and 64 and the discharge devices 66 and 68 enables a guidance of the carrier material 28 with low friction as a result of the deflection rollers 48*a* through 48*d* and, thus, with little static charging and good smoothing of the carrier material 28.

The quartz heating rods 54 are connected so as to be replaceable and are arranged transverse relative to the conveying direction P of the carrier material 28. However, a width-dependent arrangement of the quartz heating rods along the conveying direction of the carrier material 28 is also possible. The power to the quartz heating rods 54 is set and/or regulated dependent on the type and transport velocity of the carrier material 28 using the controller 55.

Figure 4:
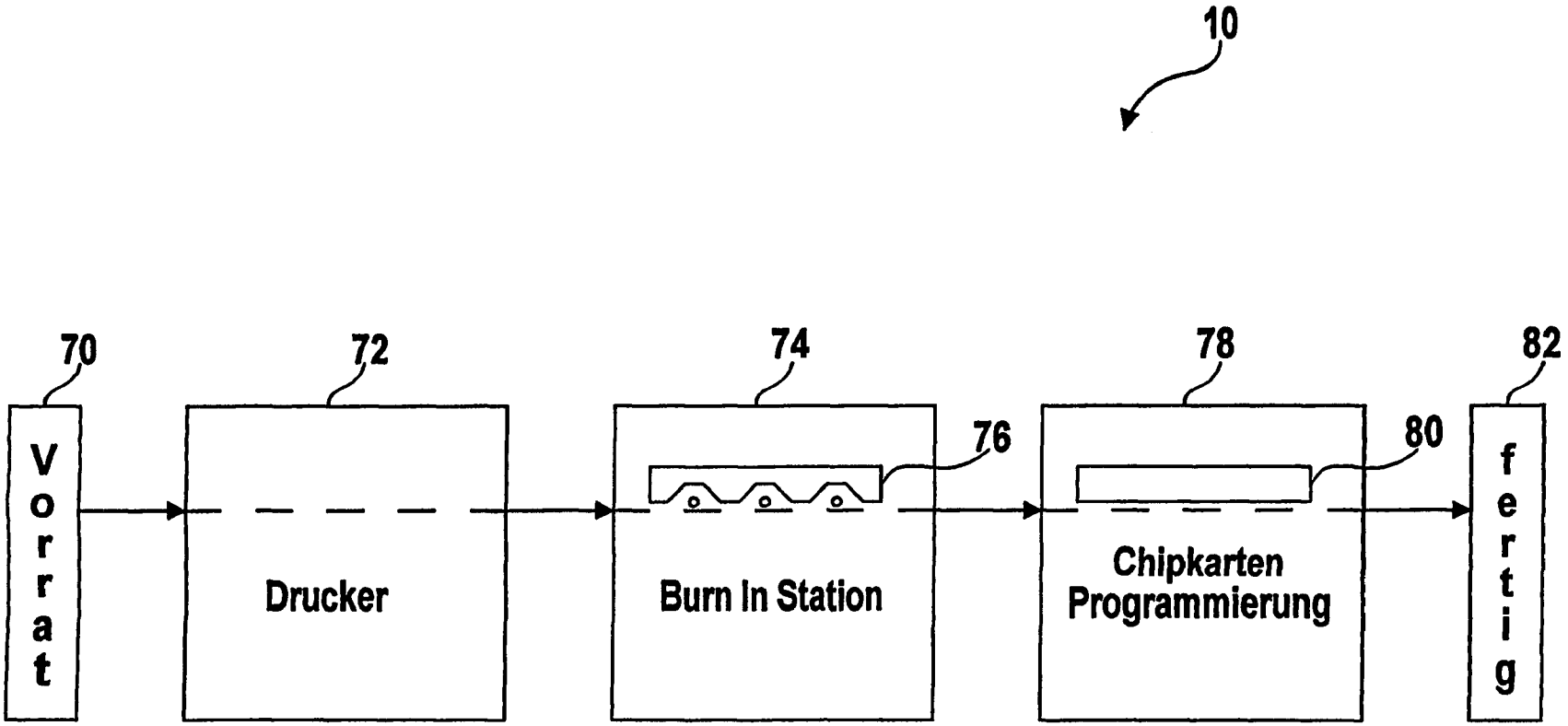
FIG. 4 is a functional block diagram that shows a printer and/or copier device for single-sided printing of carrier material according to the invention, whereby the integrated circuits contained in the carrier material are programmed in a further structural unit.

FIG. 4 shows an inventive printer and/or copier device 10 for single-sided printing of the carrier material 28 that contains chip cards. The chip cards contained in the carrier material 28 are programmed in a structural unit 78 of the printer and/or copier device 10. The printer or copier device 10 has a carrier material supply 70 from which the carrier material 28 is supplied to a printer 72 for printing, whereby a toner image is transfer-printed onto the carrier material 28 by the printer 72 and is fixed in a first fixing condition by a fixing unit (not shown) arranged in the printer 72.

The carrier material 28 which has been printed by the printer 72 is supplied to the burn-in station 74, which contains a second fixing unit 76. The fixing unit 76 is preferably a radiant fixing unit that has the same structure as the radiant fixing units 50 and 52 previously described with respect to FIG. 3. The fixing unit 76 fixes the toner image on the carrier material 28 in a second fixing condition. The carrier material 28 that has been fixed in this way is supplied to a further structural unit 78. A chip card programming device 80 is arranged in the structural unit 78. With the assistance of the chip card programming device 80, the integrated circuits that are contained in the carrier material 28 and that are suited for wireless data communication with data processing systems and/or controllers are programmed when they pass by the chip card programming device 80.

After the programming of the integrated circuits, the printed carrier material is sent to pre-designated recipients, whereby it is packaged ready for shipping in a shipping device 82. However, the printed carrier material can also be supplied to further structural units for further-processing, for example to a cutter device.

Figure 5:
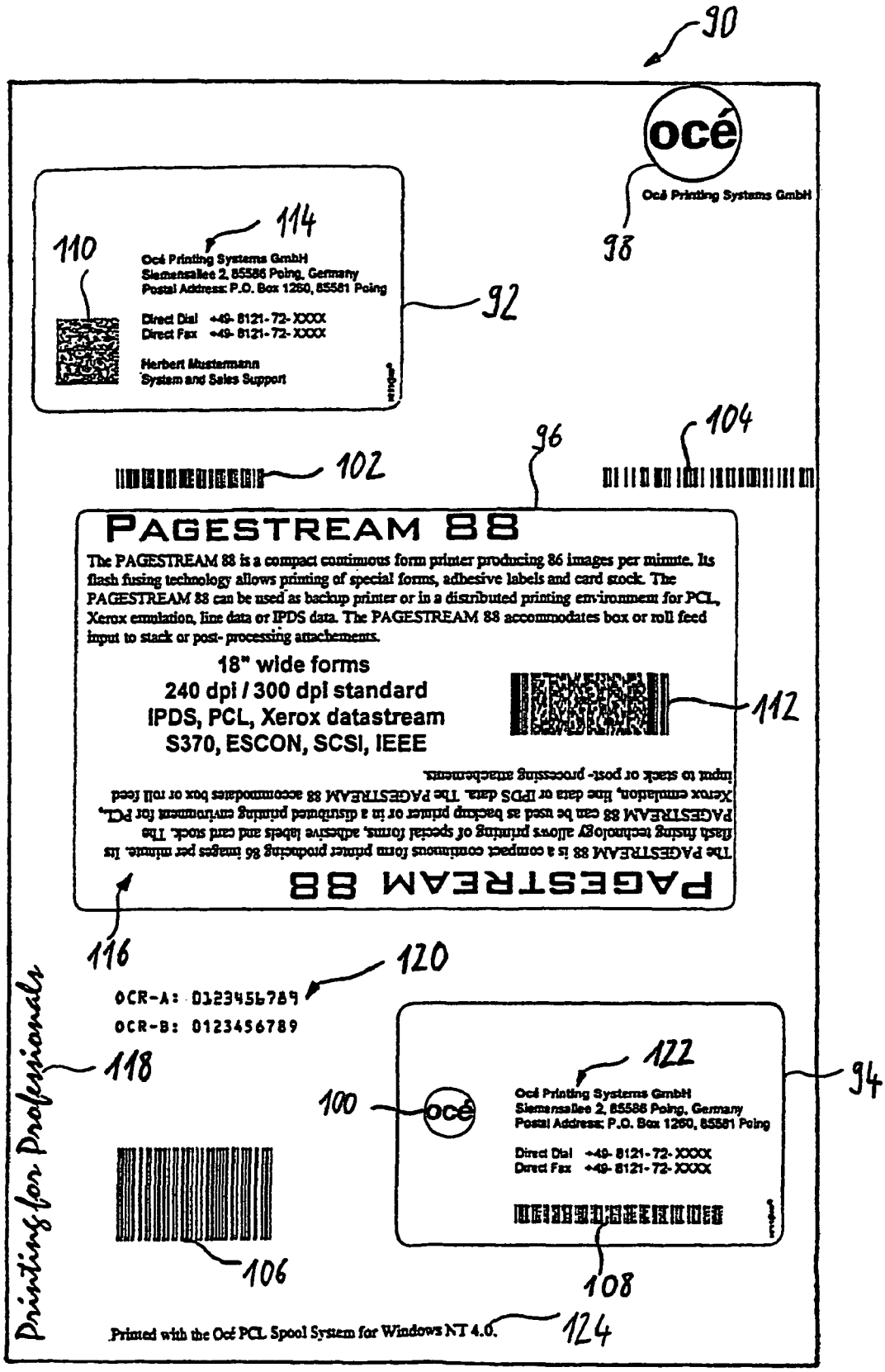
FIG. 5 shows a print page that contains various carrier materials.

FIG. 5 shows a printed page 90 that has been printed by the inventive printer and/or copier device 10 of FIG. 4 and the integrated circuits contained therein have been programmed. A paper stack of continuous form paper with transport holes and perforations is situated in the carrier material supply 70 (FIG. 4), one printed page 90 thereof being shown in FIG. 5. Just like the other printed pages of the carrier material supply 70, this printed page 90 contains chip cards 92 and 94 that are manufactured of a plastic material, contain integrated circuits and are secured on the paper of the printed page 90 with the assistance of adhesive. The integrated circuits contained in the chip cards 92 and 94 can wirelessly communicate with data processing systems and/or controllers, so that no contacts are conducted out from these chip cards.

The printed page 90 also has a self-adhesive label 96 that is pulled off from the printed page 90 and glued onto other suitable surfaces, for example onto cardboard cartons of packages or onto housing parts of devices, with the assistance of the adhesive situated on the pulled-off part of the self-adhesive label 96. The printer 72 receives print data from a data processing system (shown as 4 in FIG. 1). With the assistance of these print data, the printer 72 produces a latent image that it inks with toner with the assistance of a known developer unit, transfer-prints the toner image onto the printed page 90 as well as onto the chip cards 92 and 94 and the self-adhesive label 96 and fixes the toner image in a first fixing condition with the assistance of a first fixing unit.

The carrier materials 90, 92, 94 and 96 which have been printed on one side in this way are supplied to the burn-in station 74, which fixes the toner image in a second fixing condition. The circuits contained in the chip cards 92 and 94 are programmed with the data intended for this print job by the chip card programming device 80 in the device 78. The print data of the printed page 90 contains a plurality of graphics 98 and 100, bar codes 102, 104, 106 and 108, security elements 110 and 112, as well as a plurality of text blocks 114, 116, 118, 120, 122 and 124. The reading of the bar codes 102, 104, 106 and 108 as well as of the security elements 110 and 112 with the assistance of known reader systems is not negatively affected by the fixing in two stages. In other words, the bar codes are readable after the two stage printing.

Figure 6A:
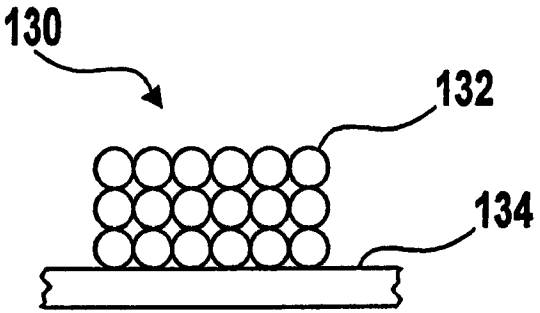
FIGS. 6*a*-6*d* show enlarged side schematic illustrations of the toner image and of the carrier material during the fixing event.

FIGS. 6*a* through 6*d* schematically show the fixing event of the toner image that has been transfer-printed onto the carrier material. In FIG. 6*a*, a transfer-printed, non-fixed toner image 130 in the form of toner powder 132 is situated on a carrier material 134, for example paper.

Figure 6B:
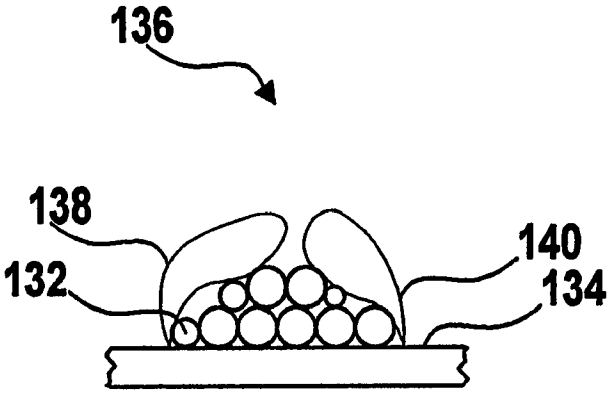

FIG. 6*b* shows a partially fixed toner image 136 that is situated on the paper 134 during the fixing event in the first fixing unit. This fixing ensues with the assistance of a photoflash fixing unit. However, other fixing units, for example radiant heat fixing units or thermal press fixing units, can also be utilized as the first fixing unit. The toner powder 132 is supplied with thermal energy by the first fixing unit. As a result of this application of heat, a part of the toner powder 132 that faces toward the fixing unit is melted. Superficially closed regions 138 and 140 of molten toner thereby arise.

Figure 6C:
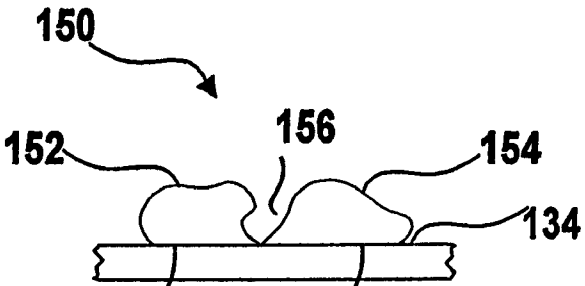

FIG. 6*c* shows a toner image 150 fixed in the first fixing condition. The toner powder 132 has completely fused to form interconnected toner regions 152 and 154 that form an uneven surface with what are referred to as craters 156. The molten toner 152 and 154 has contacting surfaces 158 and 160 with the paper 134 that cause an adhesion of the toner 152 and 154 sufficient for standard printing quality after the fixing in the first fixing condition at the paper 134. If the paper 134 is subjected to a high degree of mechanical stressing, however, the toner can potentially separate from the paper.

Figure 6D:
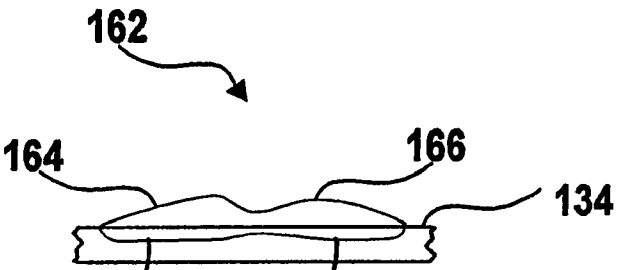

FIG. 6*d* shows a fixed toner image 162 that has been fixed in the second fixing condition with the assistance of the burn-in station 20 or 72. The toner image 150 that had been fixed in the first fixing condition is now fixed in a second fixing condition with the assistance of the second fixing units 50 and 52 or 76 arranged in the burn-in stations 20 or 74. The second fixing units 50, 52 and 76 are preferably radiant heat fixing units. The use of other fixing units is conceivable. The toner 152 and 154 fixed in the first fixing condition is melted again, whereby the second fixing unit 50, 52 and 76 supplies so much thermal energy to it that it is fluid and can penetrate into the paper 134.

The toner fixed in the second fixing condition forms regions 164 and 166 that are situated on the paper 134 and regions 168 and 170 that have penetrated into the paper 134 and firmly join the fixed toner 164 and 166 to the paper 134. The toner that has been fixed in this way remains firmly joined to the paper 134 even given hard mechanical stressing of the paper 134 and/or of the fixed toner 164 and 166. Given printed pages that have been fixed in two stages with the inventive printer and/or copier device, a durability and permanence of the print image is achieved which has only achieved previously with impact printers.

FIG. 7 shows a table with results of a test protocol of the PIRA Testing Institute. Toner images fixed on paper 28 and 134 that had been produced with the inventive printer and/or copier device 10 were investigated according to the testing guidelines for printed products which have stricter demands due to security against counterfeiting and for durability. The names of the implemented tests are recited in the first column in the table of FIG. 7. Further, the results of an investigated printed page that had been produced with the assistance of a known printer and/or copier device are recited in the column "normal fixing". Further, a printed page was investigated that had been produced with a known printer and/or copier device and that was coated with a security film. The results of the test of this printed page are recited in the column of the table labeled "enveloped with security film". The test results of the printed page that had been produced with the inventive printer and/or copier device are listed in the table column "stage fixing".

The printed page produced with the known printer and/or copier device and that what are referred to as fixed with the assistance of a single fixing unit exhibits considerable deficiencies in the eraser and in the scalpel test. Such a print page does not meet the stricter demands made for security against counterfeiting and/or the durability of the print page. When a print page produced with a known printer and/or copier device is enveloped with a security film, the properties of this print page are improved and more secure against counterfeiting compared to the print page without security film. An improvement was especially registered in the scalpel test, so that this print page enveloped with the security film passed this scalpel test.

In the erasing test, however, the print page enveloped with the security film exhibited deficiencies. A printed page produced with the inventive printer and/or copier device exhibited no deficiencies with respect to the durability and the security of the print page in the tests that were implemented. The test results are list in the table column "stage fixing". An additional enveloping of this printed page with the security film for reasons of durability and security can be foregone. The printed pages that had been fixed in two stages with the inventive printer and/or copier device revealed a durability and a permanence of the print image that was only achieved heretofore using impact printers.

What the stage-by-stage fixing of the toner image on the carrier material 28 in a first and in a second fixing condition achieves is that the heating of the carrier material 28 and, thus, the temperature stress on the carrier material 28 is lower given the same fixing result as in a known single-stage fixing.

Temperature-sensitive carrier material 28 such as, for example, films impressed with a hot-imposing method, self-adhesive labels and plastics can be printed without damaging these carrier materials 28. Integrated circuits that are contained in the carrier material 28 are also not damaged or destroyed as a result of the lower temperature stressing of the carrier material 28. The printing of thermally sensitive surfaces and thermally sensitive carrier materials 28 is thus also possible.

The surface of the toner image is smoother as a result of the second fixing event. Given print images that, for example, contain pixel graphics, one-dimensional or two-dimensional bar codes, there is no negative influence on readability due to the second fixing, particularly in the sharpness of the presentation and the edge smoothing. An inventive stage fixing without noticeable deterioration of the generated print image is possible given the use of toners with an iron constituent, what is referred to as MICRA toner, for generating magnetically readable print images The toner application on the carrier material 28 is reduced due to the farther-reaching melting process of the toner on the fixing of the toner image in the second fixing process wherein the toner penetrates into the carrier material 28. Particularly given printed products that contain a plurality of pages such as, for example, books, it is thereby possible to reduce the different thickness of the printed regions and the non-printed regions of the print pages. The curvature of such a printed product as a result of this difference in thickness can be reduced, as a result whereof the overall appearance of such a printed product can be considerably improved.

Due to the penetration of the toner into the carrier material 28, the fixing of the toner in the second fixing condition also leads to an improved adhesion and enhanced resistance to aging of the toner on the carrier material 28 and to a uniform surface of the fused toner, as a result whereof a more uniform degree of blackening is achieved. The toner concentration in the developer unit and, thus, the toner quantity on the regions of the carrier material 28 inked with toner can be reduced since a uniform degree of blackening of these regions is assured due to the fusing of the toner into the carrier material 28.

Figure 8:
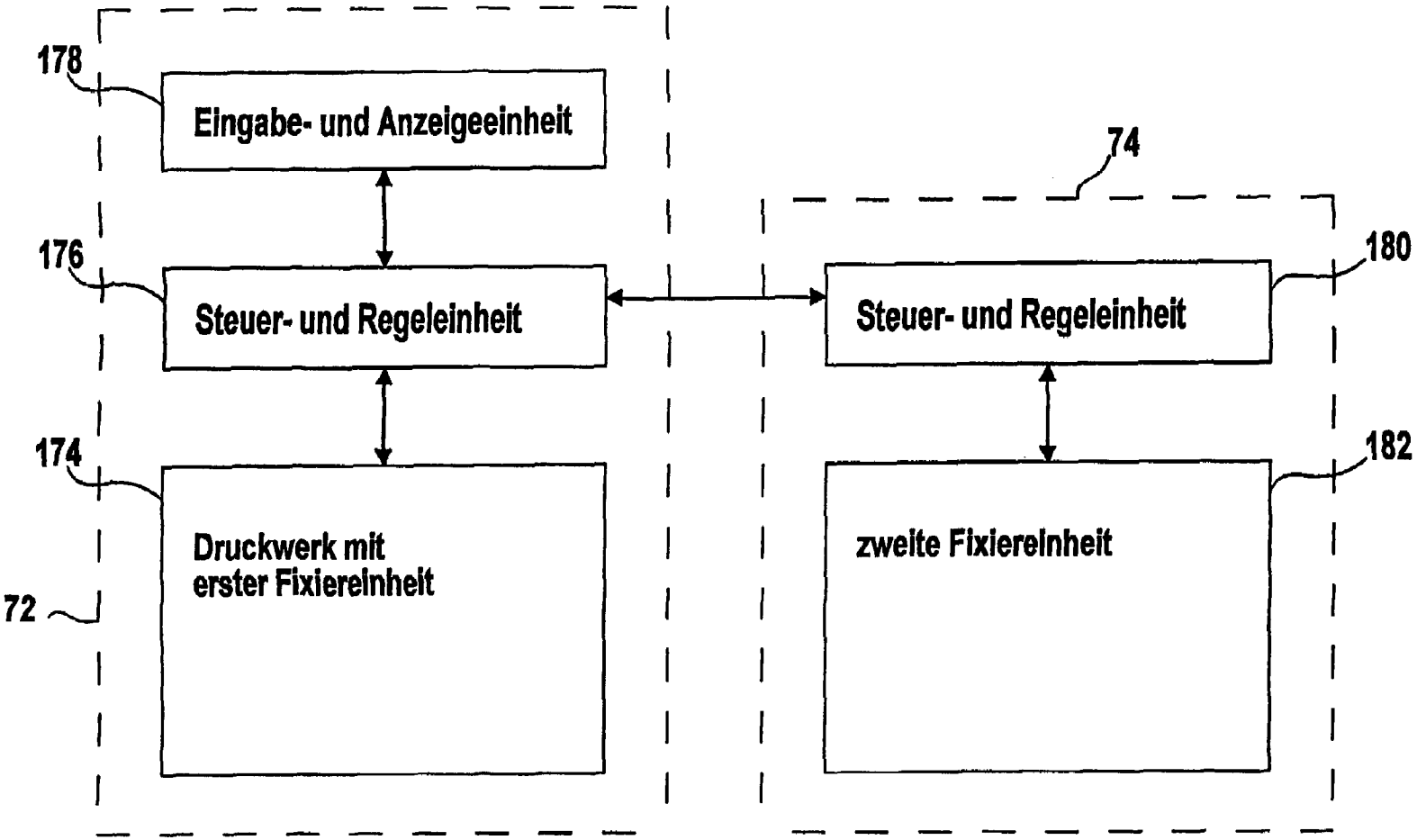
FIG. 8 is a block circuit diagram in which the collaboration of the control and regulating units of the printer and of the burn-in station is shown.

FIG. 8 shows a block circuit diagram that shows the collaboration of the control and regulating units of the printer 72 and of the burn-in station from FIG. 4. The printer 72 has a control and regulating unit 176 that is connected to an input and splay unit 178 as well as to the printing unit 174 of the printer 72. The burn-in station 74 has a control and regulating unit 180 for the control and regulation of the second fixing unit 182. The control and regulating units 176 and 180 are connected to one another via a bus connection. A data exchange between the control and regulating unit 176 of the printer 72 and the control and regulating unit 180 of the burn-in station 74 occurs with the assistance of this bus connection. The input and display unit 178 serves as a man-machine interface that enables an operator to preset printing and fixing parameters. In this applied example, the input and display unit 178 is a touch screen that is permanently installed in the housing of the printer 72.

Before the start of the print job, the operator sets the temperature sensitivity and the type of carrier material 28 at the input and display unit 178 of the printer 72. Corresponding to this presetting, the control and regulating unit 176 selects rated values for the regulation of the temperature and/or of the heat quantity of the first and of the second fixing unit. The rated value of the second fixing unit is transmitted to the control and regulating unit 180 of the burn-in station 74 via the data bus connection. Given changing process conditions, for example given a change in the paper moisture and/or the paper temperature or an increase of the ambient temperature in the printer, the control and regulating unit 176 of the printer 72 can correct these rated values, taking the preset type and temperature sensitivity of the carrier material 28 into consideration.

The control and regulating unit 180 of the burn-in station 74 regulates the performance of the second fixing unit 182 dependent on the transport velocity of the carrier material 28. When the second fixing unit 182 is, for example, a radiant fixing unit with quartz heating rods 54, then the regulation of the calorific output of the quartz heating rods 54 can be undertaken with the assistance of a phase-controllable control. However, there is also the possibility of presetting the supply voltage or the supply current of the quartz heating rods 54, preferably with the assistance of a regulatable power supply unit.

Further, a temperature sensor is arranged in the second fixing unit 182, this acquiring the temperature in the fixing unit and/or the temperature of the carrier material 28, whereby the calorific output of the second fixing unit 182 is reduced or, respectively, pivotable and controllable flaps or blinds protect the recording carrier given upward transgression of the temperature permitted for the carrier material 28.

Although other modifications and changes may be suggested by those skilled in the art, it is the intention of the inventors to embody within the patent warranted hereon all changes and modifications as reasonably and properly come within the scope of their contribution to the art.

The invention claimed is:

1. An apparatus for a printer and/or copier device to which a carrier material is supplied, the carrier material having a toner image that has been transfer-printed onto the carrier material and that has been fixed to a first fixing condition on the carrier material with a first fixing unit, comprising:

a printer and/or copier device having a printer housing;

a burn-in station coupled to the printer and/or copier device, said burn-in station including:

a second fixing unit that is operable to fix the toner image which has been fixed in a first fixing condition on the carrier material into a second fixing condition, said second fixing unit being controllable with respect to its fixing properties, and a cooling distance arranged outside of the printer housing and preceding said second fixing unit in a carrier material transport direction, said cooling distance including an air path between the first fixing unit and said second fixing unit to permit cooling of the carrier material; and a structural unit separate from said printer and/or copier device and said first fixing unit, said structural unit having said second fixing unit disposed therein.

2. An apparatus according to claim 1, wherein said second fixing unit is a radiant fixing unit.

3. An apparatus according to claim 2, wherein said radiant fixing unit is a photoflash fixing unit.

4. An apparatus according to claim 1, further comprising:

at least one of a moistening device and a cooling device and a discharge device in said burn-in station.

5. An apparatus according to claim 1, wherein said carrier material contains at least one of paper and plastic.

6. An apparatus according to claim 1, wherein said carrier material contains at least one of an active circuit and a passive circuit.

7. An apparatus according to claim 1, wherein said first and second fixing units are operable to cause the toner to penetrate the carrier material sufficient to produce printed products that meet strict demands of protection against at least one of counterfeiting and of adhesion of toner.

8. An apparatus according to claim 1, wherein said first and second fixing units are operable to produce a fixed image that exhibits a firm union with the carrier material.

9. An apparatus according to claim 1, wherein said printer and/or copier device is operable to transfer print the toner image page-by-page, and said first and second fixing units are operable to fix each transfer-printed toner image.

10. An apparatus according to claim 1, wherein said first and second fixing units are operable so that each toner image is fixed by heating to a glass transition point in said first fixing unit and again in said second fixing unit so the toner image is fixed by at least two fixing devices that are separate from one another.

11. An apparatus according to claim 1, wherein said first fixing unit is constructed and mounted to fix a toner image that has been transfer-printed onto a front side of the carrier material in duplex printing;

said second fixing unit being operable to fix the toner image on the front side that has been fixed by the first fixing unit; and further comprising:

a third fixing unit operable to fix a toner image that has been transfer-printed onto a back side of the carrier material; and a fourth fixing unit operable to fix the toner image on the back side that has been fixed by the third fixing unit.

12. An apparatus according to claim 11, wherein said second and fourth fixing units are disposed and operable to simultaneously fix the toner images of the front side and back side.

13. An apparatus according to claim 11, wherein at least one of said first fixing unit and said third fixing unit is operable to supply sufficient thermal energy to the toner image and to the carrier material that the toner of the toner image melts and unites with a surface of the carrier material.

14. An apparatus according to claim 11, wherein at least one of said second and fourth fixing units supply sufficient thermal energy to the toner image and the carrier material that the toner of the toner image melts and penetrates into the carrier material.

15. An apparatus according to claim 11, wherein at least one of said first and second and third and fourth fixing units is operable to apply thermal energy onto the toner image without applying force onto the toner image and onto the carrier material.

16. An apparatus according to claim 11, further comprising:

a separate housing in which at least one of said second and fourth fixing units is provided, said separate housing for said at least one of said second and fourth fixing units being free of a common housing with said printing unit and said first fixing unit.

17. An apparatus according to claim 11, further comprising:

a cooling distance preceding said second and fourth fixing units, said cooling distance being sufficient for the toner image that was heated to above the glass transition point in the first and third fixing units, respectively, to cool in said cooling distance prior to being heated to above the glass transition point in said second and fourth fixing units, respectively.

18. An apparatus according to claim 1, further comprising:

an input and display unit of the printer and/or copier device into which properties of the carrier material are set.

19. An apparatus as claimed in claim 18, wherein said properties of the carrier material include type and temperature sensitivity of the carrier material.

20. An apparatus according to claim 19, further comprising:

at least one control and regulating unit that regulates heat quantity supplied to the carrier material by at least one of said first and second fixing units dependent on a type and temperature sensitivity of the carrier material.

21. An apparatus as claimed in claim 1, wherein said first fixing unit and said second fixing unit are free of a common housing.

22. An apparatus as claimed in claim 1, wherein said first fixing unit is constructed and mounted to fix a toner image that has been transfer-printed onto a front side of the carrier material in duplex printing;

said second fixing unit being operable to fix the toner image on the front side that has been fixed by the first fixing unit;

a third fixing unit operable to fix a toner image that has been transfer-printed onto a back side of the carrier material; and wherein said third fixing unit is operable to transfer print and fix the toner image of the back side after the toner image of the front side is transfer-printed and fixed.

23. An apparatus as claimed in claim 1, wherein said first fixing unit heats the carrier material sufficiently that the toner reaches the glass transition point.

24. An apparatus for a printer and/or copier device to which a carrier material is supplied, the carrier material having a toner image that has been transfer-printed onto the carrier material and that has been fixed to a first fixing condition on the carrier material with a first fixing unit, comprising:

a burn-in station coupled to the printer and/or copier device, said burn-in station including:

a second fixing unit that is operable to fix the toner image which has been fixed in a first fixing condition on the carrier material into a second fixing condition, said second fixing unit being controllable with respect to its fixing properties, and a cooling distance arranged preceding said second fixing unit in a carrier material transport direction, said cooling distance including an air path between the first fixing unit and said second fixing unit;

wherein said first fixing unit is constructed and mounted to fix a toner image that has been transfer-printed onto a front side of the carrier material in duplex printing;

said second fixing unit being operable to fix the toner image on the front side that has been fixed by the first fixing unit;

a third fixing unit operable to fix a toner image that has been transfer-printed onto a back side of the carrier material; and a fourth fixing unit operable to fix the toner image on the back side that has been fixed by the third fixing unit;

wherein said third fixing unit is operable to transfer print and fix the toner image of the back side after the toner image of the front side is transfer-printed and fixed.

25. An apparatus for a printer and/or copier device to which a carrier material is supplied, the carrier material having a toner image that has been transfer-printed onto the carrier material and that has been fixed to a first fixing condition on the carrier material with a first fixing unit, comprising:

a burn-in station coupled to the printer and/or copier device, said burn-in station including:

a second fixing unit that is operable to fix the toner image which has been fixed in a first fixing condition on the carrier material into a second fixing condition, said second fixing unit being controllable with respect to its fixing properties, and a cooling distance arranged preceding said second fixing unit in a carrier material transport direction, said cooling distance including an air path between said first fixing unit and said second fixing unit to permit cooling of the carrier material;

wherein said printer and/or copier device is a first printer and/or copier device;

a second printer and/or copier device arranged successively with said first printer and/or copier device, said second printer and/or copier device having an internal fixing unit for fixing a print image generated by the second printing and/or copier unit; and at least one further separate fixing unit following said first and second printing units.

26. A printer and/or copier device, comprising:

a printing unit having a carrier material transport path and operable to generate a latent image and to develop the latent image with toner and to transfer-print the developed toner image onto a carrier material, said printing unit having a printing unit housing;

a first fixing unit in said carrier material transport path and operable to fix the transfer-printed toner image in a first fixing condition on the carrier material by heating the toner image to the glass transition point for the toner, said first fixing unit being in said printing unit housing;

a second fixing unit in said carrier material transport path and operable to fix the image fixed by said first fixing unit in a second fixing condition by heating the toner image to the glass transition point;

a control unit connected to control at least one of said first and second fixing units with respect to its fixing properties, and a cooling distance arranged preceding said second fixing unit relative to a carrier material transport direction, said cooling distance including an air path outside said printing unit housing and between said first fixing unit and said second fixing unit, said air path permitting cooling of the toner image between the first and second fixing units.

27. An apparatus according to claim 26, wherein at least said second fixing unit is a radiant fixing unit.

28. An apparatus according to claim 27, wherein said radiant fixing unit is a photoflash fixing unit.

29. An apparatus according to claim 26, further comprising:

a structural unit separate from said printer and/or copier device and said first fixing unit, said structural unit having said second fixing unit arranged therein.

30. An apparatus according claim 26, further comprising:

at least one of a moistening device and a cooling device and a discharge device in said printer and/or copier device.

31. An apparatus according to claim 26, wherein said carrier material contains at least one of paper and plastic.

32. An apparatus according to claim 26, wherein said carrier material contains at least one of an active circuit and a passive circuit.

33. An apparatus according to claim 26, wherein said carrier material includes self-adhesive labels.

34. An apparatus according to claim 26, wherein said first and second fixing units are operable to cause the toner to penetrate the carrier material sufficient to produce printed products that meet strict demands of protection against at least one of counterfeiting and of adhesion of toner.

35. An apparatus according to claim 34, wherein said first and second fixing units are operable to produce a fixed image that exhibits a firm union with the carrier material.

36. An apparatus according to claim 26, wherein said printer and/or copier device is operable to transfer print the toner image page-by-page, and said first and second fixing units are operable to fix each transfer-printed toner image.

37. An apparatus according to claim 26, wherein said first and second fixing units are operable so that each toner image is fixed by at least two fixing devices that are separate from one another.

38. An apparatus according to claim 26, wherein said first fixing unit is constructed and mounted to fix a toner image that has been transfer-printed onto a front side of the carrier material in duplex printing;

said second fixing unit being operable to fix the toner image on the front side that has been fixed by the first fixing unit; and further comprising:

a third fixing unit operable to fix a toner image that has been transfer-printed onto a back side of the carrier material; and a fourth fixing unit operable to fix the toner image on the back side that has been fixed by the third fixing unit.

39. An apparatus according to claim 38, wherein said second and fourth fixing units simultaneously fix the toner images of the front side and back side.

40. An apparatus according to claim 38, wherein at least one of said first fixing unit and said third fixing unit is operable to supply so much thermal energy to the toner image and to the carrier material that the toner of the toner image melts and unites with the surface of the carrier material.

41. An apparatus according to claim 38, wherein at least one of said second and fourth fixing units supply sufficient thermal energy to the toner image and the carrier material that the toner of the toner image melts and penetrates into the carrier material.

42. An apparatus according to claim 38, wherein at least one of said first and second and third and fourth fixing units is operable to apply thermal energy onto the toner image without applying force onto the toner image and onto the carrier material.

43. An apparatus according to claim 38, further comprising:

a separate housing in which at least one of said second and fourth fixing units is provided, said separate housing being physically separate from said first fixing unit and said printing unit, said separate housing being free of a common housing with said first fixing unit and said printing unit, said separate housing being mounted spaced by a distance from any housing enclosing said first fixing unit and said printing unit.

44. An apparatus according to claim 38, further comprising:

a cooling distance preceding said second and fourth fixing units.

45. An apparatus according to claim 26, further comprising:

an input and display unit of the printer and/or copier device into which properties of the carrier material are set.

46. An apparatus as claimed in claim 45, wherein said properties of the carrier material includes type and temperature sensitivity of the carrier material.

47. An apparatus according to claim 26, further comprising:

at least one control and regulating unit that regulates heat quantity supplied to the carrier material by at least one of said first and second fixing units dependent on a type and temperature sensitivity of the carrier material.

48. A printer and/or copier device, comprising:

a printing unit having a carrier material transport path and operable to generate a latent image and to develop the latent image with toner and to transfer-print the developed toner image onto a carrier material;

a first fixing unit in said carrier material transport path and operable to fix the transfer-printed toner image in a first fixing condition on the carrier material;

a second fixing unit in said carrier material transport path and operable to fix the image fixed by said first fixing unit in a second fixing condition;

a control unit connected to control at least one of said first and second fixing units with respect to its fixing properties, a cooling distance arranged preceding said second fixing unit relative to a carrier material transport direction, said cooling distance including an air path between said first fixing unit and said second fixing unit so as to permit cooling of the carrier material;

wherein said first fixing unit is constructed and mounted to fix a toner image that has been transfer-printed onto a front side of the carrier material in duplex printing;

said second fixing unit being operable to fix the toner image on the front side that has been fixed by the first fixing unit;

a third fixing unit operable to fix a toner image that has been transfer-printed onto a back side of the carrier material; and a fourth fixing unit operable to fix the toner image on the back side that has been fixed by the third fixing unit;

wherein said third fixing unit is operable to transfer print and fix the toner image of the back side after the toner image of the front side is transfer-printed and fixed.

49. A printer and/or copier device, comprising:

a printing unit having a carrier material transport path and operable to generate a latent image and to develop the latent image with toner and to transfer-print the developed toner image onto a carrier material;

a first fixing unit in said carrier material transport path and operable to fix the transfer-printed toner image in a first fixing condition on the carrier material;

a second fixing unit in said carrier material transport path and operable to fix the image fixed by said first fixing unit in a second fixing condition;

a control unit connected to control at least one of said first and second fixing units with respect to its fixing properties, a cooling distance arranged preceding said second fixing unit relative to a carrier material transport direction, said cooling distance including an air path between said first fixing unit and said second fixing unit;

wherein said first fixing unit is constructed and mounted to fix a toner image that has been transfer-printed onto a front side of the carrier material in duplex printing;

said second fixing unit being operable to fix the toner image on the front side that has been fixed by the first fixing unit;

a third fixing unit operable to fix a toner image that has been transfer-printed onto a back side of the carrier material; and a fourth fixing unit operable to fix the toner image on the back side that has been fixed by the third fixing unit;

wherein said printer and/or copier device is a first printer and/or copier device;

a second printer and/or copier device arranged successively with said first printer and/or copier device, said second printer and/or copier device having an internal fixing unit for fixing a print image generated by the second printing and/or copier unit; and at least one further separate fixing unit following said first and second printing units.

50. A method for printing a carrier material, comprising the steps of:

providing a carrier material to a printer housing;

transfer printing a toner image onto the carrier material in the housing to generate a transfer-printed toner image;

fixing the transfer-printed toner image in a first fixing condition on the carrier material in the printer housing in a first fixing stage by heating the toner image to the glass transition point for the toner;

moving the carrier material with the transfer-printed toner image out of the printer housing;

fixing the toner image fixed in the first fixing stage in a second fixing condition in a second fixing stage by heating the toner image to the glass transition point for the toner;

controlling the fixing in at least one of the first and second fixing stages with respect to its fixing properties; and providing a cooling distance following said first fixing stage and outside said printer housing and preceding the second fixing stage.

* * * * *

UNITED STATES PATENT AND TRADEMARK OFFICE

CERTIFICATE OF CORRECTION

PATENT NO. : 7,245,866 B2
APPLICATION NO. : 10/312237
DATED : July 17, 2007
INVENTOR(S) : Georg Fröhlich It is certified that error appears in the above-identified patent and that said Letters Patent is hereby corrected as shown below:

In The Drawings

Signed and Sealed this

Eighth Day of January, 2008

JON W. DUDAS
*Director of the United States Patent and Trademark Office*

UNITED STATES PATENT AND TRADEMARK OFFICE

CERTIFICATE OF CORRECTION

PATENT NO. : 7,245,866 B2
APPLICATION NO. : 10/312237
DATED : July 17, 2007
INVENTOR(S) : Georg Fröhlich It is certified that error appears in the above-identified patent and that said Letters Patent is hereby corrected as shown below:

Replace Sheet 4, Figure 4, of the drawings with the following Figure 4.

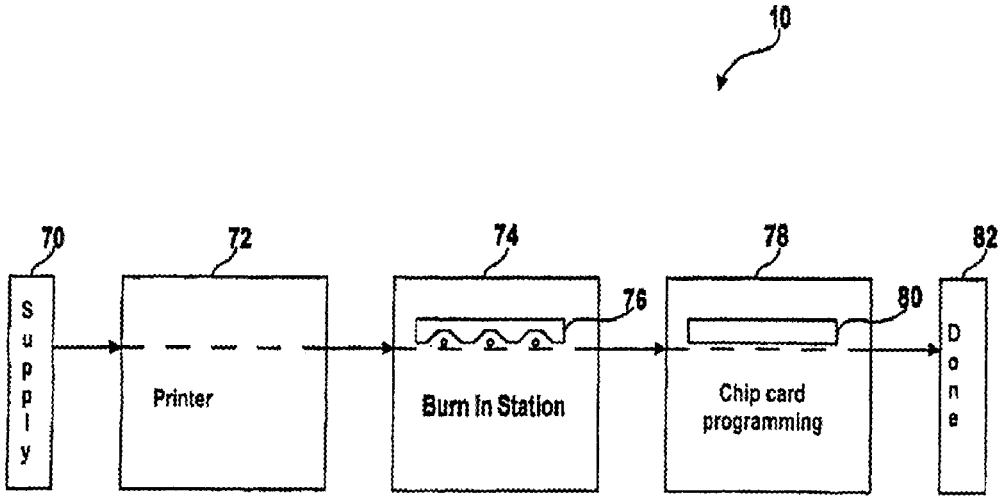

Fig. 4

UNITED STATES PATENT AND TRADEMARK OFFICE

CERTIFICATE OF CORRECTION

PATENT NO. : 7,245,866 B2
APPLICATION NO. : 10/312237
DATED : July 17, 2007
INVENTOR(S) : Georg Fröhlich It is certified that error appears in the above-identified patent and that said Letters Patent is hereby corrected as shown below:

Replace Sheet 7, Figure 7, with the following Figure 7.

Test protocol: Security Printing
Testing Institute: PIRA
Quality Criteria: according to APACS classification

| Test | Normal fixing | Enveloped with security film | Stage fixing |
|---|---|---|---|
| Blu-Tack | 1 | 1 | 1 |
| Eraser | 3 | 2 | 1 |
| Scalpel | 4 | 1 | 1 |
| Scalpel (aged specimen) | 1 | 1 | 1 |

Fig. 7

UNITED STATES PATENT AND TRADEMARK OFFICE

CERTIFICATE OF CORRECTION

PATENT NO. : 7,245,866 B2
APPLICATION NO. : 10/312237
DATED : July 17, 2007
INVENTOR(S) : Georg Fröhlich It is certified that error appears in the above-identified patent and that said Letters Patent is hereby corrected as shown below:

Replace Sheet 8, Figure 8, with the following Figure 8.

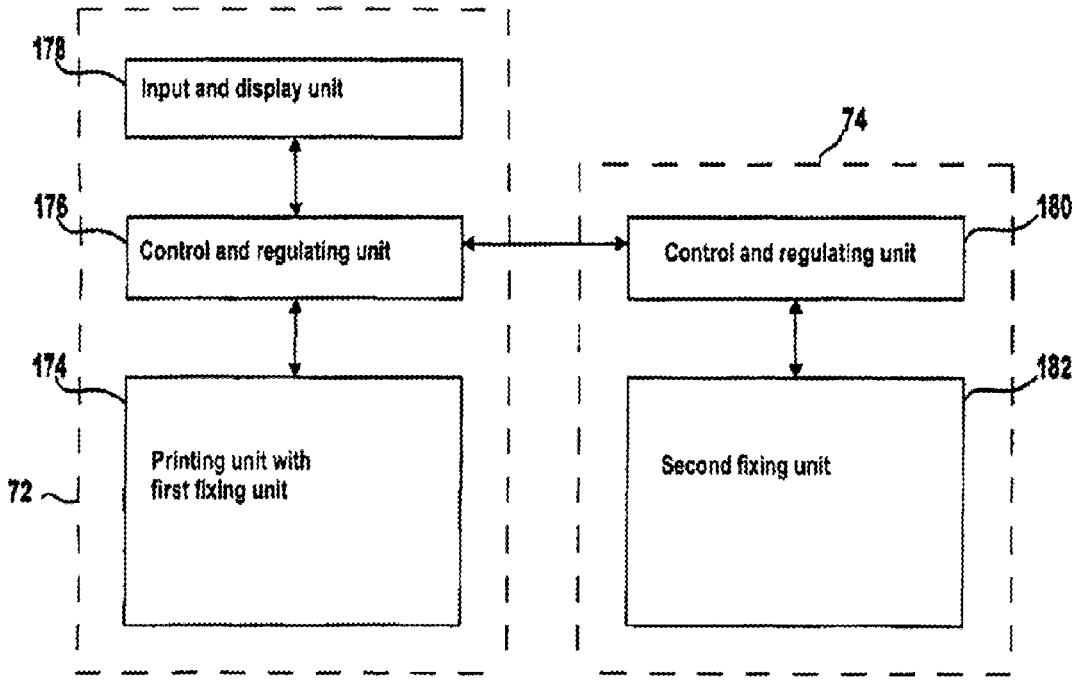

Fig. 8